US005632203A

United States Patent [19]

Voeltner et al.

[11] Patent Number: 5,632,203

[45] Date of Patent: May 27, 1997

[54] ANTI-GHOSTING ROLLER

[75] Inventors: Frederick A. Voeltner, Milwaukee; Nicholas R. Schetter, Rubicon, both of Wis.

[73] Assignee: Quad Graphics, Inc., Sussex, Wis.

[21] Appl. No.: 490,156

[22] Filed: Jun. 14, 1995

[51] Int. Cl.[6] ..... B41F 1/46

[52] U.S. Cl. ..... 101/348; 101/DIG. 38; 101/375

[58] Field of Search ..... 101/216, 219, 101/177, 180, 348, 349, 350, 351, 375, DIG. 31, DIG. 38; 74/569

[56] References Cited

U.S. PATENT DOCUMENTS

| | | | |
|---|---|---|---|
| 3,672,298 | 6/1972 | Reif | 101/350 |
| 4,113,327 | 9/1978 | Koch | 74/565 |
| 4,397,236 | 8/1983 | Greiner et al. . | |
| 4,449,451 | 5/1984 | Junghans | 101/350 |
| 4,455,934 | 6/1984 | Van Der Roer | 101/177 |
| 4,718,344 | 1/1988 | Lemaster . | |
| 4,729,308 | 3/1988 | Witczak | 101/350 |
| 4,756,249 | 7/1988 | Hardin . | |
| 4,777,877 | 10/1988 | Lemaster . | |
| 4,829,645 | 5/1989 | Kannwischer . | |
| 4,861,173 | 8/1989 | Kemp . | |
| 4,887,533 | 12/1989 | Lemaster et al. . | |
| 5,062,362 | 11/1991 | Kemp | 101/348 |
| 5,085,142 | 2/1992 | Smith . | |
| 5,209,160 | 5/1993 | Smith . | |
| 5,363,763 | 11/1994 | Fiore . | |
| 5,423,256 | 6/1995 | Villarreal | 101/349 |

FOREIGN PATENT DOCUMENTS

| | | | |
|---|---|---|---|
| 2197261 | 5/1988 | United Kingdom | 101/DIG. 38 |

*Primary Examiner*—Eugene H. Eickholt

*Attorney, Agent, or Firm*—Michael, Best & Friedrich

[57] ABSTRACT

An anti-ghosting roller having a main shaft, an inner race detachably mounted on the main shaft, a rotary bearing having movable bearing elements (e.g., needle bearings) positioned on the inner race, a roller core secured to the rotary bearing, and an end collar mounted to the shaft and spaced from an end of the roller core such that the roller core can both rotate and axially oscillate relative to the main shaft. The inner race extends beyond the end of the rotary bearing. An end collar is mounted to the end of the shaft. The end collar includes a spacer portion extending axially toward the roller core. The spacer portion is radially spaced from the main shaft so that it is free from interaction with the inner race.

26 Claims, 1 Drawing Sheet

ANTI-GHOSTING ROLLER

FIELD OF THE INVENTION

The present invention generally relates to the field of offset printing presses. More specifically, the present invention relates to anti-ghosting rollers for use on offset printing presses for alleviating ghosting problems.

BACKGROUND OF THE INVENTION

Offset printing presses are used in the printing industry to apply ink to a printing medium (e.g., paper). Such printing presses typically include a plurality of rollers for transferring ink from an ink fountain to a plate cylinder which provides a printed image to a blanket cylinder which, in turn, provides the printed image to the printing medium. The rollers typically include ink fountain rollers that transfer ink from an ink fountain to distributor rollers which, in turn, transfer the ink to form rollers. The form rollers transfer the ink to the plate cylinder.

In order to provide enhanced distribution of ink on the plate cylinder, and further to inhibit the formation of ghost images, it is known to utilize form rollers that oscillate axially relative to the plate cylinder. Such form rollers are commonly called "anti-ghosting" rollers since they reduce the occurrence of ghost images. To provide for both rotational and axial movement, anti-ghosting rollers can include a combination of linear roller bearings and rotational needle bearings. The linear roller bearings ride directly on a hardened steel shaft, and the rotational needle bearings provide rotation between the linear roller bearings and the form roller.

SUMMARY OF THE INVENTION

The present invention utilizes an anti-ghosting roller having a main shaft, an inner race detachably mounted on the main shaft, a rotary bearing having movable bearing elements (e.g., needle bearings) positioned on the inner race, a roller core secured to the rotary bearing, and an end collar mounted to the shaft and spaced from an end of the roller core such that the roller core can both rotate and axially oscillate relative to the main shaft. Unexpectedly, it has been found that the rotary bearing can ride directly on the inner race, without the provision of an intermediate linear bearing. Since only one bearing is used, the roller design is significantly simplified. In addition, since there is no bearing that rides directly on the main shaft, the life of the main shaft is significantly extended. That is, the bearing and inner race can be replaced without having to replace the main shaft.

In order to accommodate axial oscillation of the roller core, the inner race preferably extends beyond the end of the rotary bearing. The end collar is spaced from the end of the roller core such that the roller core can both rotate and axially oscillate relative to the main shaft. The end collar can be moved to adjust the amount of oscillation, and can also be moved toward the roller core to prevent oscillation of the roller core. In this regard, to accommodate the inner race which extends beyond the end of the rotary bearing, the end collar includes a spacer portion (e.g., an annular tubular portion) extending axially toward the roller core. The spacer portion is radially spaced from the main shaft so that it is free from interaction with the inner race. A low friction washer can be positioned between the spacer portion and the roller core to allow relatively free rotation of the roller core.

DETAILED DESCRIPTION

Figure 1:
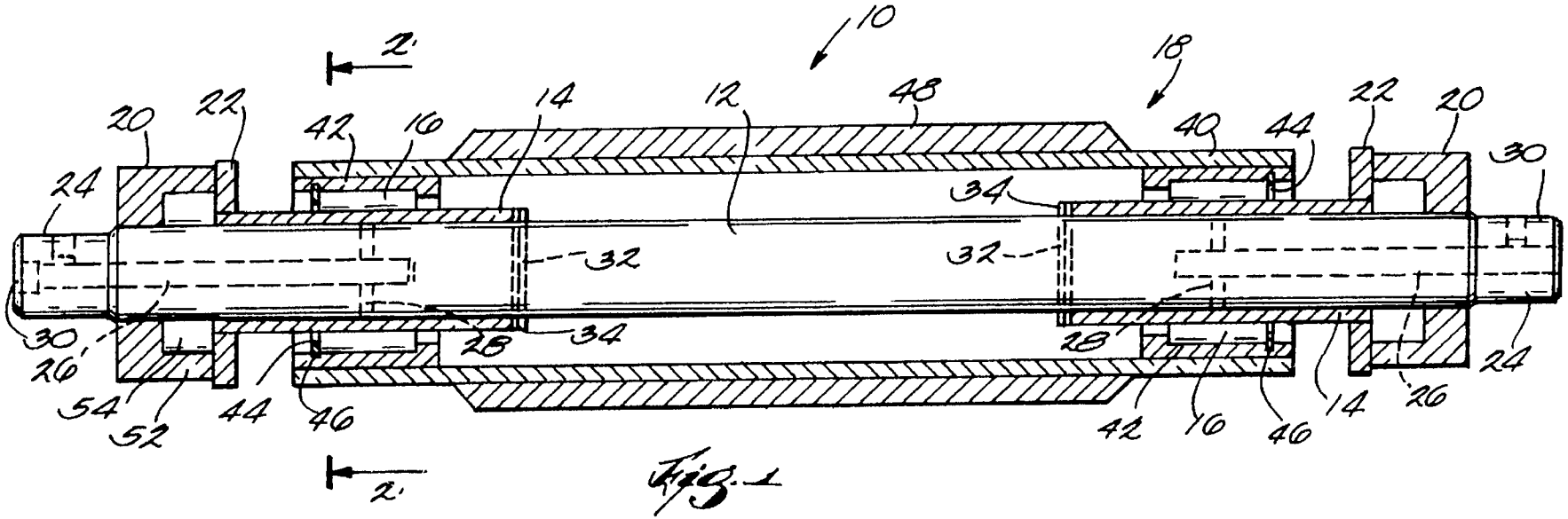
FIG. 1 is a section view of an anti-ghosting roller embodying the present invention.

FIG. 1 illustrates one embodiment of the present invention. The illustrated roller 10 includes a main shaft 12 (not shown in section), an inner race 14, a rotary bearing 16, a roller core 18, two end collars 20, and two low friction washers 22. Each of the above-mentioned components, and their interaction with the other components, will be described below in more detail.

The illustrated main shaft 12 is made from steel, such as 1045 TGP. By virtue of the provision of the inner races 14, the main shaft 12 does not need to be hardened, thereby significantly reducing the cost of the main shaft 12. Both ends of the shaft include a reduced diameter portion 24 that can be clamped in a printing press (not shown). Each end further includes an axially-extending passageway 26 in communication with two radially-extending ports 28. The outer end of each axially-extending passageway 26 includes a threaded portion 30 for interconnecting with a lubrication supply conduit (not shown) so that lubrication can be provided to the rotary bearings 16 via the ports 28. Two laterally-extending holes 32 extend through the main shaft 12 and are designed to accommodate roll pins 34 that limit the inward travel of the inner races 14 on the main shaft 12, as described below.

In the illustrated embodiment, each inner race 14 comprises a tubular-shaped member made from precision ground steel. For example, a suitable commercially available bearing can be obtained from RBC Bearing Co. under part number IR-7285. The inner races 14 are positioned over the main shaft 12 such that the ends of the inner races 14 contact the corresponding roll pin 34. In operation, there is preferably no relative movement between the inner races 14 and the main shaft 12. In this regard, the inner races 14 can be press fit or heat shrunk onto the main shaft 12.

Figure 2:
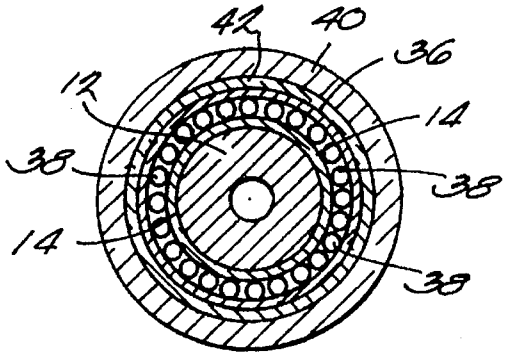
FIG. 2 is a section view taken along line 2—2 in FIG. 1.

The rotary bearings 16 are mounted for axial and rotational movement relative to the inner races 14. Referring to FIG. 2, the illustrated rotary bearings 16 comprise needle bearings, each having an outer housing 36 and a plurality of needle bearing elements 38 positioned on the inner race 14. Rotation of the outer housing 36 relative to the inner race 14 is provided by rotation of the needle bearing elements 38. Axial movement of the outer housing 36 relative to the inner race 14 is provided by sliding contact between the needle bearing elements 38 and the inner race 14. As noted above, lubrication for the rotary bearing 16 is provided through the radially-extending ports 28.

Referring back to FIG. 1, the outer housings 36 of the rotary bearings 16 are press fit into opposing ends of the roller core 18. The illustrated roller core 18 includes a tube 40 comprised of a DOM welded tube, and two sleeves 42 of 1045 steel secured into the ends of the tube 40. A retaining clip 44 is positioned within a retaining groove 46 of each sleeve 42 to hold the rotary bearings 16 within the sleeves 42. The roller core 18 is covered with a rubber member 48. The illustrated rubber member 48 was coated with a Premier Rubber Covering by the Ideal Roller Company.

Figure 3:
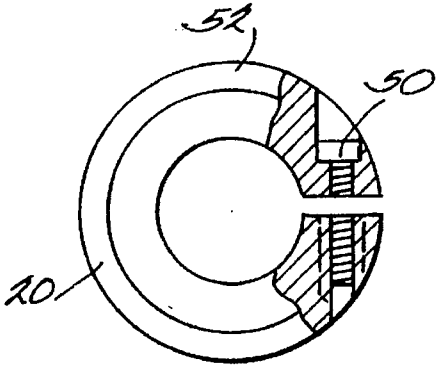
FIG. 3 is an enlarged end view of a locking collar used in the roller illustrated in FIG. 1.

The end collars 20 are positioned over the main shaft 12, and can be releasably secured to the main shaft 12 by virtue of collar bolts 50 (FIG. 3). Each end collar 20 includes a spacer portion 52 in the form of an annular tubular portion extending toward the roller core 18. The spacer portion 52 defines an annular recess 54 between the spacer portion 52 and the main shaft 12. The annular recess 54 is designed to accommodate the portion of the inner race 14 which extends beyond the end of the roller core 18. Accordingly, by virtue of the annular recess 54, the end collars 20 (i.e., the spacer portions) can be moved toward the roller core 18 to limit the oscillation of the roller core 18.

The low friction washers 22 are positioned between the spacer portion 52 of the end collar 20 and the roller core 18. The washers 22 of the illustrated embodiment are made from Nylon 66 filled with molybdenum disulphide sold under the trademark Nylatron GSM by the Polymer Corporation. The washers 22 provide a low friction interface between the spacer portions 52 of the end collars 20 and the roller core 18, and further function to reduce the amount of wear on the end collars 20 and roller core 18.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described herein are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. An offset printing press comprising:

a blanket cylinder;

a plate cylinder in operative association with said blanket cylinder; and an anti-ghosting roller in operative association with said plate cylinder, said anti-ghosting roller including:

a main shaft;

an inner race mounted on said main shaft;

a rotary bearing having movable bearing elements positioned on said inner race, said bearing elements being rotationally and axially movable relative to said inner race; and a roller core connected to said rotary bearing.

2. An offset printing press as claimed in claim 1, wherein said inner race extends beyond an end of said rotary bearing.

3. An offset printing press as claimed in claim 1, wherein said inner race is detachably secured to said main shaft.

4. An offset printing press as claimed in claim 1, wherein said main shaft comprises non-hardened steel.

5. An offset printing press as claimed in claim 1, wherein said bearing elements comprise needle bearings having rotational axes positioned in alignment with a rotational axis of said main shaft.

6. An offset printing press comprising:

a blanket cylinder;

a plate cylinder in operative association with said blanket cylinder; and an anti-ghosting roller in operative association with said plate cylinder, said anti-ghosting roller including:

a main shaft;

an inner race secured to said main shaft; and a roller core mounted for rotation and for axial oscillation relative to said inner race, said inner race extending beyond an end of said roller core.

7. An offset printing press as claimed in claim 6, wherein said main shaft comprises a non-hardened steel.

8. An offset printing press as claimed in claim 6, wherein said inner race is detachably secured to said main shaft.

9. An offset printing press as claimed in claim 6, further comprising a rotary bearing having movable bearing elements positioned on said inner race.

10. An offset printing press as claimed in claim 7, wherein said movable bearing elements comprise needle bearings having rotational axes positioned in alignment with a rotational axis of said main shaft.

11. An offset printing press as claimed in claim 6, further comprising an end collar mounted to said shaft and spaced from an end of said roller core such that said roller core can both rotate and linearly oscillate relative to said main shaft, wherein said end collar includes a spacer portion extending axially toward said roller core, said spacer portion being radially spaced from said main shaft.

12. An offset printing press as claimed in claim 11, wherein said spacer portion comprises an annular tubular portion extending from said end collar toward said roller core.

13. An anti-ghosting roller for use on an offset printing press, said roller comprising:

a main shaft;

an inner race mounted on said main shaft;

a rotary bearing having movable bearing elements positioned on said inner race, said bearing elements being rotationally and axially movable relative to said inner race; and a roller core connected to said rotary bearing.

14. An anti-ghosting roller as claimed in claim 13, wherein said inner race extends beyond an end of said rotary bearing.

15. An anti-ghosting roller as claimed in claim 13, wherein said inner race is detachably secured to said main shaft.

16. An anti-ghosting roller as claimed in claim 13, wherein said main shaft comprises non-hardened steel.

17. An anti-ghosting roller as claimed in claim 13, wherein said bearing elements comprise needle bearings having rotational axes positioned in alignment with a rotational axis of said main shaft.

18. An anti-ghosting roller as claimed in claim 13, further comprising an end collar mounted to an end of said shaft and spaced from an end of said roller core such that said roller core can both rotate and linearly oscillate relative to said main shaft, said end collar having a spacer portion extending axially toward said roller core, said spacer portion being radially spaced from said main shaft.

19. An anti-ghosting roller as claimed in claim 18, wherein said roller includes two end collars positioned on opposing ends of said shaft.

20. An anti-ghosting roller as claimed in claim 19, wherein at least one of said two end collars is detachably connected to said main shaft such that said end collar can be moved axially relative to said main shaft.

21. An anti-ghosting roller as claimed in claim 18, wherein said spacer portion comprises an annular tubular portion extending from said end collar toward said roller core.

22. An anti-ghosting roller as claimed in claim 18, further comprising a low friction washer positioned between said spacer portion and said roller core.

23. An anti-ghosting roller as claimed in claim 22, wherein said low friction washer comprises nylon 66 filled with molybdenum disulphide.

24. An offset printing press comprising:

a blanket cylinder;

a plate cylinder in operative association with said blanket cylinder; and an anti-ghosting roller in operative association with said plate cylinder, said anti-ghosting roller including:

a main shaft comprising non-hardened steel;

an inner race mounted on said main shaft;

a rotary bearing having movable bearing elements positioned on said inner race; and a roller core secured to said rotary bearing.

25. An offset printing press comprising:

a blanket cylinder;

a plate cylinder in operative association with said blanket cylinder; and an anti-ghosting roller in operative association with said plate cylinder, said anti-ghosting roller including:

a main shaft comprising non-hardened steel;

an inner race secured to said main shaft; and a roller core mounted for rotation relative to said inner race, said inner race extending beyond an end of said roller core.

26. An anti-ghosting roller for use on an offset printing press, said roller comprising:

a main shaft comprising non-hardened steel;

an inner race mounted on said main shaft;

a rotary bearing having movable bearing elements positioned on said inner race; and a roller core secured to said rotary bearing.

* * * * *